US009293071B2

(12) United States Patent
Burkhart et al.

(10) Patent No.: US 9,293,071 B2
(45) Date of Patent: Mar. 22, 2016

(54) GRAPHIC PANEL ASSEMBLY

(71) Applicant: Target Brands, Inc., Minneapolis, MN (US)

(72) Inventors: Nicole R. Burkhart, Waconia, MN (US); Tracy M. Cogan, Lakeville, MN (US)

(73) Assignee: Target Brands, Inc., Minneapolis, MN (US)

( * ) Notice: Subject to any disclaimer, the term of this patent is extended or adjusted under 35 U.S.C. 154(b) by 332 days.

(21) Appl. No.: 13/783,556

(22) Filed: Mar. 4, 2013

(65) Prior Publication Data

US 2014/0245592 A1 Sep. 4, 2014

(51) Int. Cl.
*G09F 7/20* (2006.01)
*G09F 15/00* (2006.01)

(52) U.S. Cl.
CPC ..... *G09F 7/20* (2013.01); *G09F 15/0018* (2013.01); *Y10T 29/49963* (2015.01)

(58) Field of Classification Search
CPC ..... G09F 7/02; G09F 7/04; G09F 7/10; G09F 2007/1847; G09F 2007/1852; G09F 1/10; G09F 1/103; E04F 11/1804; A47G 1/1646; A47G 1/16; A47G 1/17; A47G 1/24; A47B 96/06; A47B 96/07
See application file for complete search history.

(56) References Cited

U.S. PATENT DOCUMENTS

| | | | | |
|---|---|---|---|---|
| 3,115,719 | A | 12/1963 | Mapson | |
| 3,868,800 | A | 3/1975 | Peterson | |
| 4,143,846 | A | 3/1979 | Rock et al. | |
| 4,193,233 | A | 3/1980 | VandenHoek et al. | |
| 4,485,602 | A | 12/1984 | Flamboe, Jr. et al. | |
| 4,549,712 | A | 10/1985 | Simon et al. | |
| 4,960,258 | A | 10/1990 | Stocker et al. | |
| 5,472,163 | A | 12/1995 | Callas | |
| 5,542,219 | A | 8/1996 | Dias | |
| 5,609,317 | A | 3/1997 | Glynn et al. | |
| 5,711,100 | A * | 1/1998 | Elmer | 40/592 |
| 6,098,941 | A * | 8/2000 | Gates et al. | 248/224.51 |
| 7,810,265 | B2 | 10/2010 | Beatty | |
| 8,234,805 | B2 | 8/2012 | Dukes et al. | |
| 2005/0167547 | A1 | 8/2005 | McLellan | |
| 2010/0147122 | A1 * | 6/2010 | Hurt et al. | 83/34 |

* cited by examiner

*Primary Examiner* — Cassandra Davis
(74) *Attorney, Agent, or Firm* — Leanne Taveggia Farrell; Westman, Champlin & Koehler, P.A.

(57) ABSTRACT

A graphic panel assembly includes a graphic holder. The graphic holder includes a base having an upper support portion for coupling to a graphic and a lower support portion including an aperture. The graphic holder also includes a hardware assembly. The hardware assembly includes a bored rod having a threaded exterior and a threaded interior and a magnetic foot fixedly mated to the threaded interior of the bored rod. The threaded exterior is positioned within the aperture located in the lower support portion of the base. The bored rod is rotatable within the aperture to adjust a distance between the base and the magnetic foot.

20 Claims, 11 Drawing Sheets

GRAPHIC PANEL ASSEMBLY

BACKGROUND

Retail establishments use various types of display structures to present products to customers for purchase and to provide signage for conveying product information. An example display structure includes a gondola display unit, which can be configured into a shelving display unit having a base deck, a pair of uprights, a back, a top rail and at least one shelf. Multiple gondola display units can be placed adjacent to each other to create an aisle for supporting products.

The discussion above is merely provided for general background information and is not intended to be used as an aid in determining the scope of the claimed subject matter.

SUMMARY

A graphic panel assembly includes a graphic holder. The graphic holder includes a base having an upper support portion for coupling to a graphic panel and a lower support portion including an aperture. The graphic holder also includes a hardware assembly. The hardware assembly includes a bored rod having a threaded exterior and a threaded interior and a magnetic foot fixedly mated to the threaded interior of the bored rod. The threaded exterior is positioned within the aperture located in the lower support portion of the base. The bored rod is rotatable within the aperture to adjust a distance between the base and the magnetic foot. The magnetic foot is configured to be magnetically coupled to a display unit.

The graphic panel assembly further includes at least one channel mounted to a back side of the graphic panel and configured to receive the upper support portion of the graphic holder. The hardware assembly is rotatable within the aperture in the lower support portion to adjust a height of the graphic panel relative to a floor on which the display unit is supported.

A method of adjusting a height of the graphic panel includes inserting the upper support portion of the graphic holder into the channel mounted to a back side of the graphic panel. The hardware assembly is magnetically coupled to a top of the display unit and a handle fixedly attached to a proximal end of the bored rod is rotated in one of a clockwise direction or a counterclockwise direction to adjust a height of the graphic panel relative to the floor on which the display unit is supported.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

An adjustable bracket or graphic holder is for use in mounting a graphic panel to a top of a display unit. Often, in a retail store, display units, such as gondola display units, are positioned adjacent to each other to form an aisle. Because the floor on which the display units is supported may be uneven and/or tops of the display units may be uneven relative to each other, mounting graphic panels across multiple display units can make the graphic panels appear crooked or out of alignment. The adjustable bracket or graphic holder described in detail below provides a base having an upper flange for coupling to a back side of a graphic panel and a lower flange having an opening. A hardware assembly or fastener located within the opening in the lower flange includes a magnet that is magnetically coupled to the top of a gondola display unit. The hardware assembly or fastener is rotatable within the opening in the lower flange to adjust a height of the graphic panel relative to the floor on which the display unit is supported.

Figure 1:
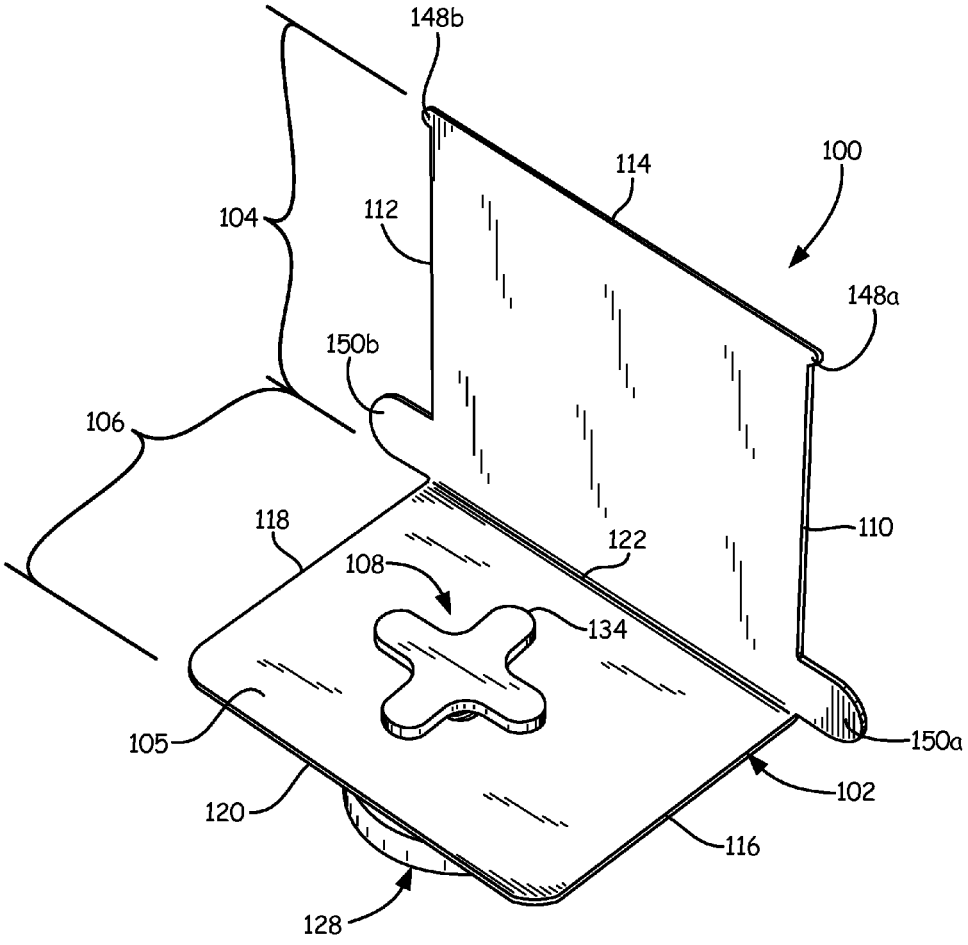
FIG. 1 is a perspective view of an adjustable bracket according to one embodiment.
Figure 2:
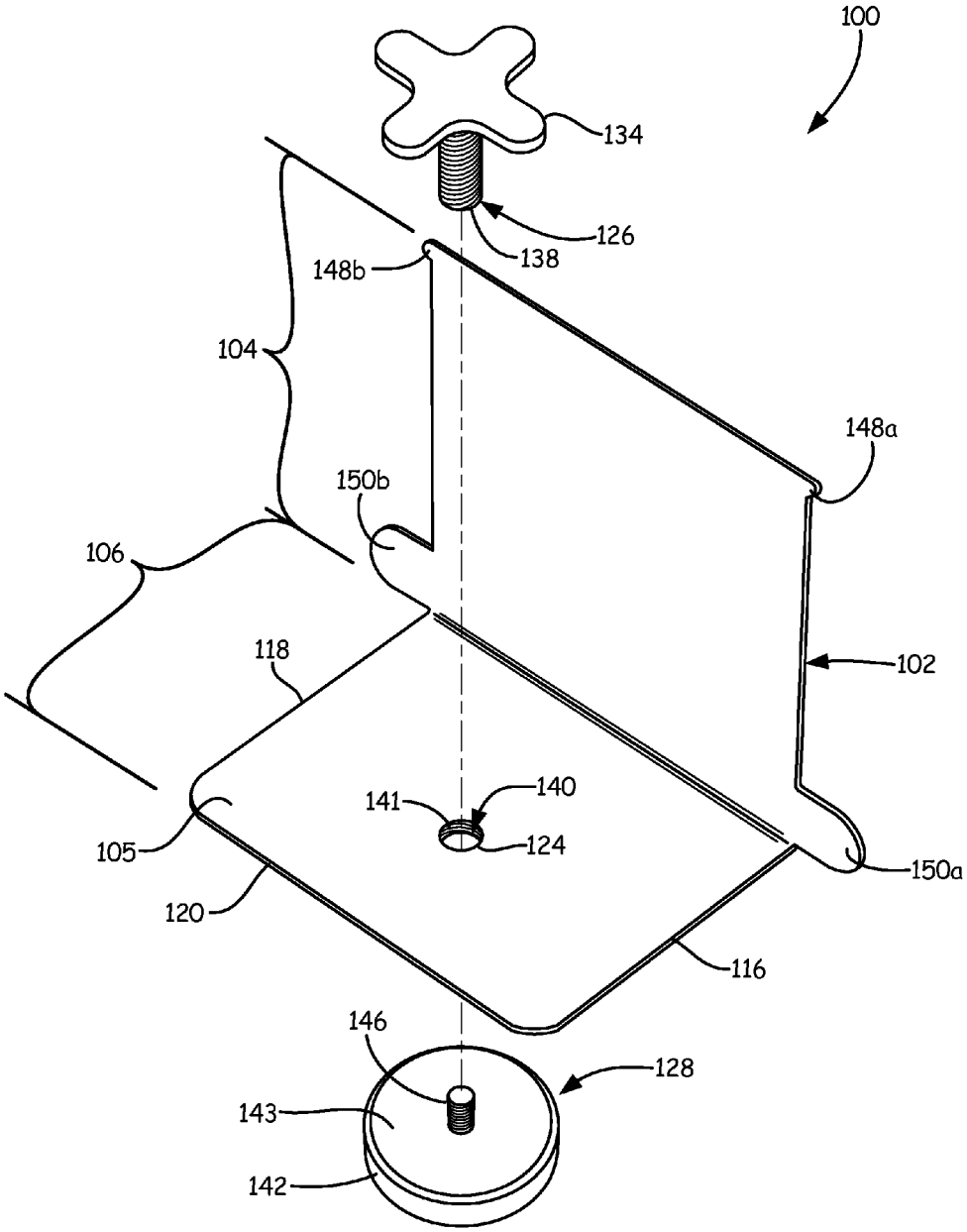
FIG. 2 is an exploded perspective view of the adjustable bracket illustrated in FIG. 1.

FIG. 1 is a perspective view of an adjustable bracket or graphic holder 100. FIG. 2 is an exploded perspective view of adjustable bracket or graphic panel holder 100. The front, the back, the right side (the left side being a mirror image), the top and the bottom of assembled adjustable bracket or graphic panel holder 100 are illustrated in FIGS. 3-7. Adjustable bracket or graphic holder 100 includes a hardware assembly or fastener 108 and a base or main body 102 having an upper support portion or upper flange 104 and a lower support portion or lower flange 106. Upper support portion or upper flange 104 is configured to be mounted to a graphic or graphic panel, such as graphic or graphic panel 160 illustrated in FIGS. 9-15. As illustrated in FIGS. 1-7 coupled to lower support portion or lower flange 106 is hardware assembly or fastener 108.

Upper flange 104 includes opposing side edges 110 and 112 and an upper edge 114. Lower flange 106 includes opposing side edges 116 and 118 and a front edge 120. Upper flange 104 and lower flange 106 are coupled together by a bend 122 and are oriented substantially normal to each other. In addition, not only are side edges 110, 112, 116 and 118 substantially perpendicular to bend 122, side edge 110 of upper flange 104 is in linear alignment with side edge 116 of lower flange 106 and side edge 112 of upper flange 104 is in linear alignment with side edge 118 of lower flange 106. In addition, upper edge 114 of upper flange 104 is substantially parallel with front edge 120 of lower flange 106.

As illustrated in more detail in the exploded perspective view of FIG. 2, lower flange 106 includes an aperture or opening 124 that extends from a top surface 105 to a bottom surface 107. Aperture or opening 124 is located substantially in the center of lower flange 106. In other words, the center of opening 124 is located at a midpoint relative to front edge 120 and located at a midpoint relative to side edges 116 and 118. Base or main body 102 further includes a nut 140 illustrated in FIGS. 2-5. Nut 140 is fixedly secured to bottom surface 107 of lower flange 106 and includes a threaded hole 141 (shown in FIG. 2) that aligns with aperture or opening 124 in lower flange 106. Nut 140 provides aperture or opening 124 with a threaded interior.

Figure 7:
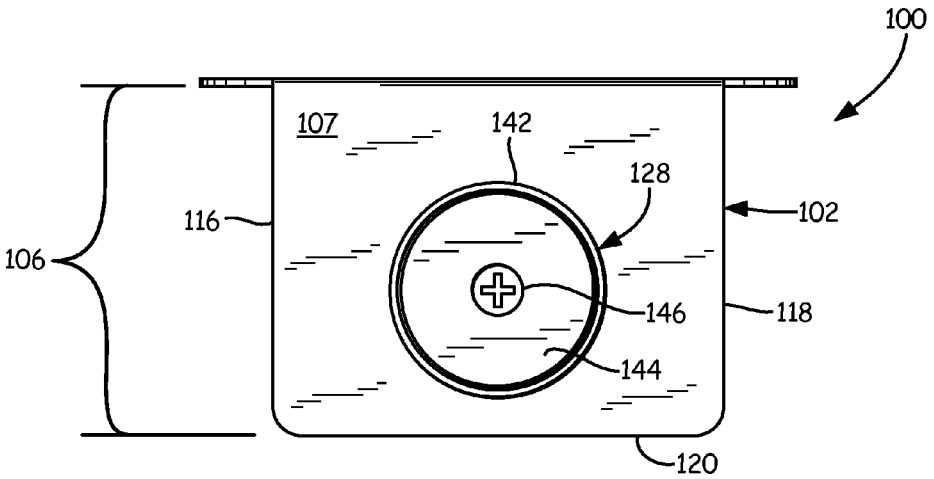
FIG. 7 is a bottom view of the adjustable bracket illustrated in FIG. 1.
Figure 8:
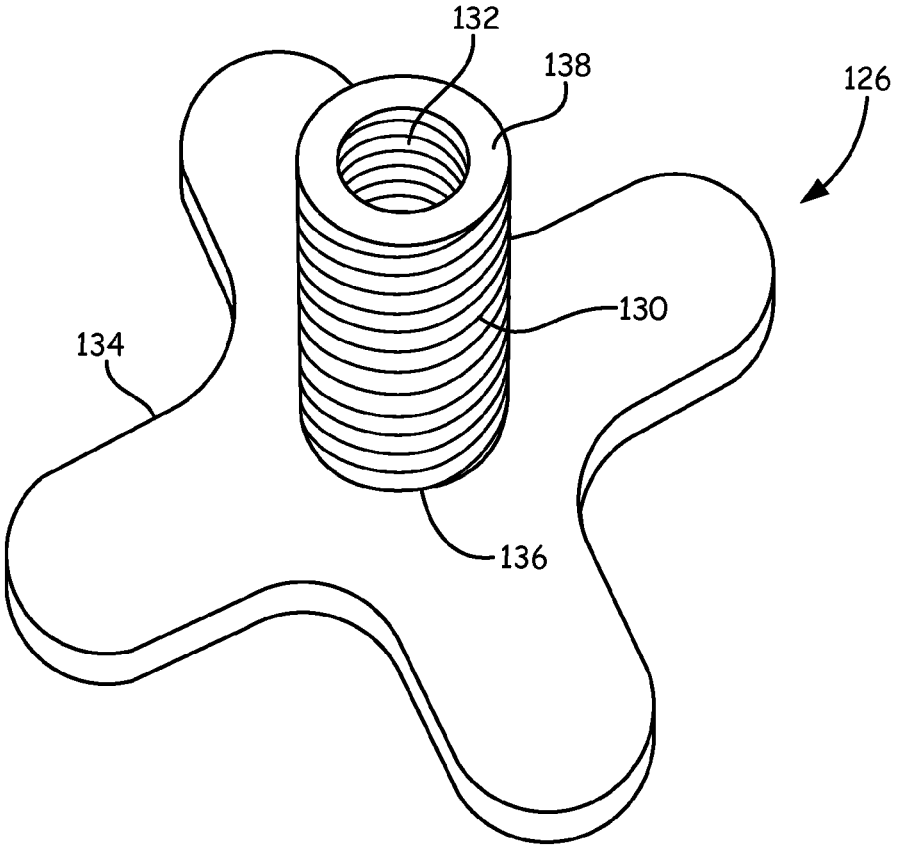
FIG. 8 is a bottom perspective view of a stud of the adjustable bracket illustrated in FIG. 1.

Fastener 108 includes a rod or stud 126, a magnetic foot 128 and a handle 134. In one embodiment and as illustrated in FIG. 8, rod or stud 126 is bored and includes a threaded exterior 130, a threaded interior 132, a first end or a proximal end 136 and a second end or distal end 138. Handle 134 is fixedly attached to first end or proximal end 136 of rod 126. As illustrated in FIG. 7, magnetic foot 128 includes a housing 142 and a magnet 144. Housing 142 surrounds and is attached to a portion of magnet 144 so that only one side of magnet 144 is exposed to the environment. Magnet 144 is capable of producing a permanent magnetic field. For example, magnet 144 can be formed of a ferromagnetic or ferromagnetic material that retains its own magnetization and can respond to other magnetic fields. In general, a permanent magnet is made of some type of metallic material that work is applied to in order to magnetize it. Further, housing 142 and magnet 144 include holes (hidden from view) that align with each other and received a threaded screw 146 as illustrated in FIGS. 2 and 7.

As illustrated in FIGS. 1-7, bored rod or stud 126 is located within aperture or opening 124 of lower flange 106 and threaded exterior 130 of bored rod or stud 126 rotatably mates with aperture or opening 124 using threaded hole 141 of nut 140. Threaded interior 132 of bored rod or stud 126 fixedly mates with magnetic foot 128 using threaded screw 146. As such and as illustrated in FIGS. 1 and 2-7, handle 134 is located above lower flange 106, rod or stud 126 rides in or is rotatable within threaded hole 141 of nut 140 and distal end 138 of rod or stud 126 abuts a top surface 143 of housing 142 of magnetic foot 128. Housing 142 and therefore magnetic foot 128 and magnet 144 are located below lower flange 106 and below nut 140.

Because magnetic foot 128 is fixedly attached to threaded interior 132 of bored rod or stud 126 and because handle 134 is fixedly attached to proximal end 136 of rod or stud 126, magnetic foot 128 including housing 142 and magnet 144 as well as handle 134 are all simultaneously rotatable within aperture or opening 124 and threaded hole 141 of nut 140. Therefore, when handle 134, rod or stud 126 and magnetic foot 128 are rotated within opening 124 and threaded hole 141 of nut 140, a relative distance between magnetic foot 128 and base 102 is adjustable. For example, when handle 134 is rotated in a clockwise direction 133 (FIG. 6), a distance 146 (FIGS. 3 and 5) between bottom surface 107 of lower flange 106 and top surface 143 of magnetic foot 128 increases to thereby adjust graphic or graphic panel 160 (to which upper flange 104 is mounted) upwardly. In another example, when handle 134 is rotated in a counterclockwise direction 135 (FIG. 6), distance 146 between bottom surface 107 of lower flange 106 and top surface 143 of magnetic foot 128 decreases to thereby adjust graphic or graphic panel 160 (to which upper flange 104 is mounted) downwardly.

Figure 3:
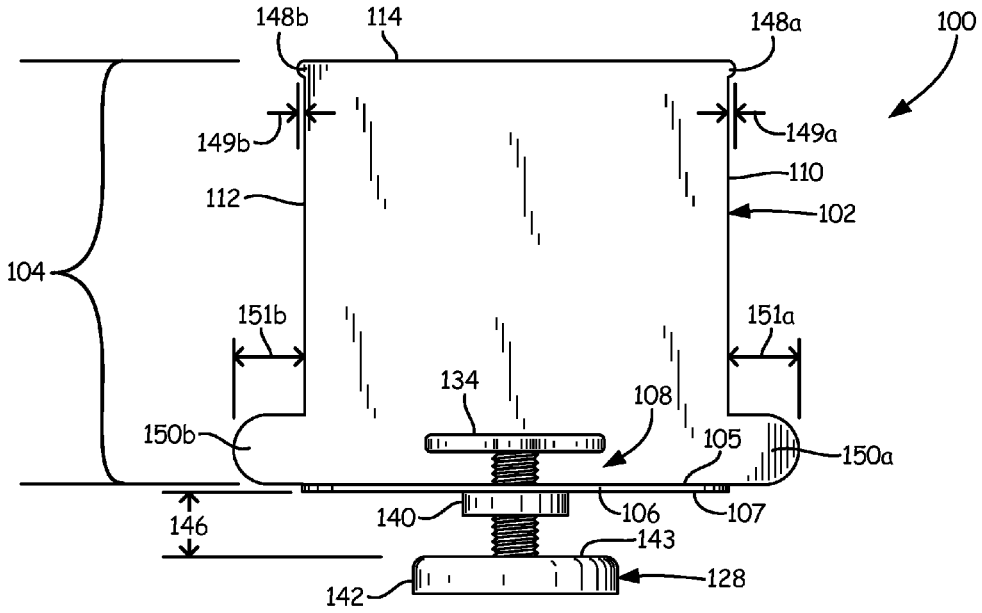
FIG. 3 is front view of the adjustable bracket illustrated in FIG. 1.
Figure 4:
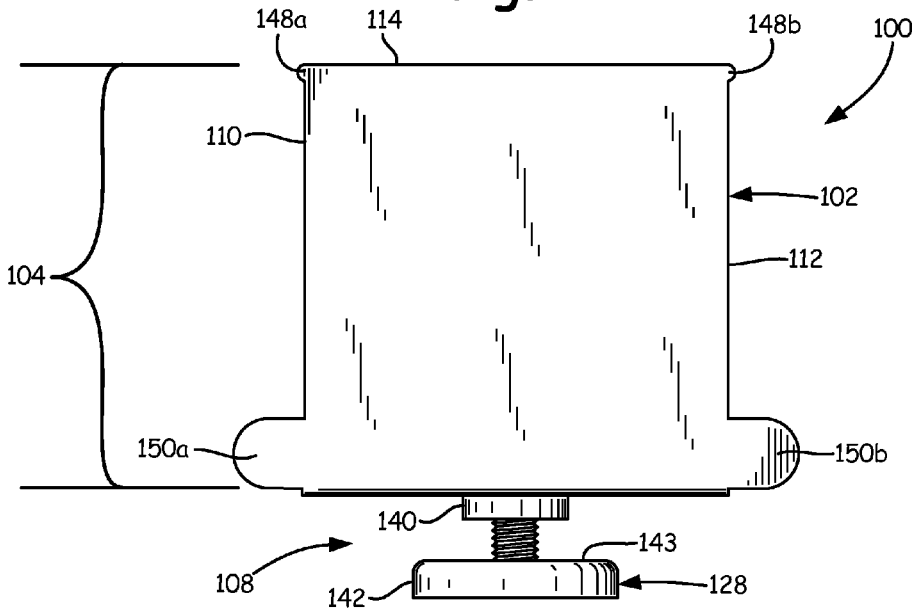
FIG. 4 is back view of the adjustable bracket illustrated in FIG. 1.
Figure 5:
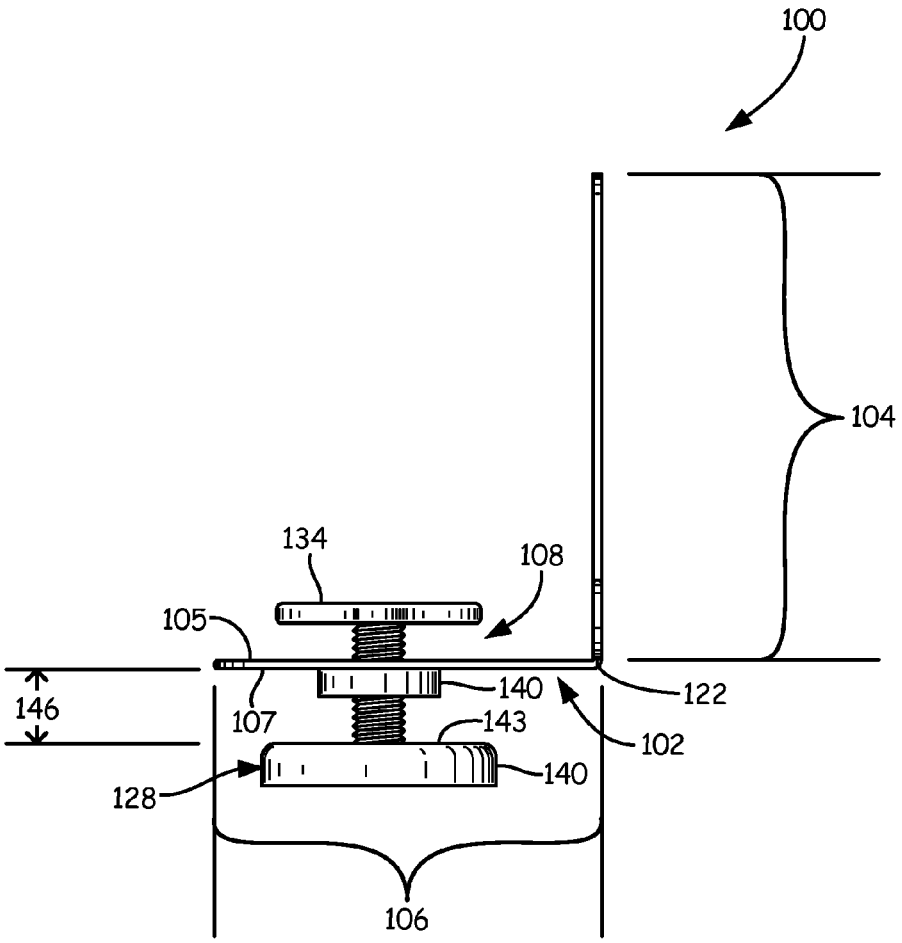
FIG. 5 is a side view of the adjustable bracket illustrated in FIG. 1.
Figure 6:
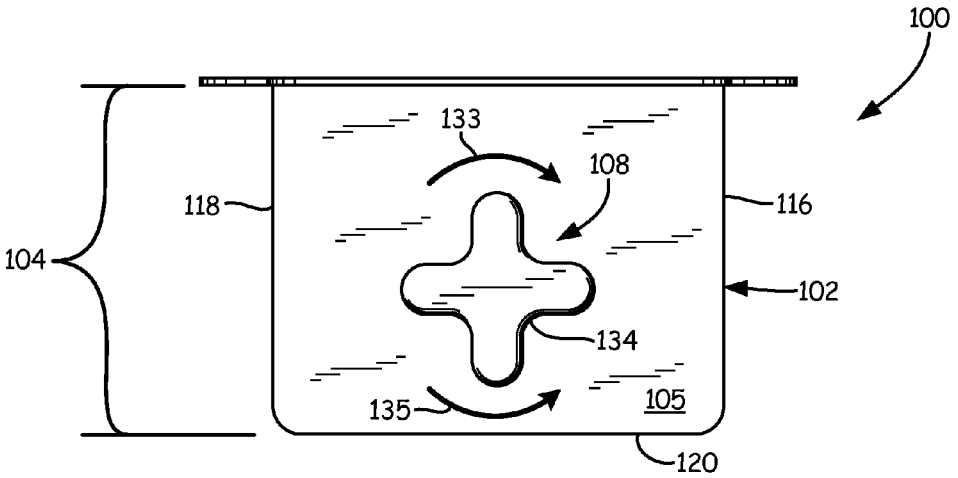
FIG. 6 is a top view of the adjustable bracket illustrated in FIG. 1.

Furthermore, upper flange 104 of base 102 includes a pair of upper ears 148*a* and 148*b* and a pair of lower ears 150*a* and 150*b*. The pair of upper ears 148*a* and 148*b* are spaced apart from the pair of lower ears 150*a* and 150*b*. Upper ear 148*a* extends outwardly from side edge 110 of upper flange 104 a distance 149*a* (FIG. 3) and upper ear 148*b* extends outwardly from side edge 112 of upper flange 104 a distance 149*b* (FIG. 3). Lower ear 150*a* extends outwardly from side edge 110 of upper flange 104 a distance 151*a* (FIG. 3) and lower ear 150*b* extends outwardly from side edge 112 of upper flange 104 a distance 151*b* (FIG. 3). Distances 149*a* and 149*b* are substantially identical and distance 151*a* and 151*b* are substantially identical. In addition, distances 151*a* and 151*b* are greater than or larger than distances 149*a* and 149*b*.

Figure 9:
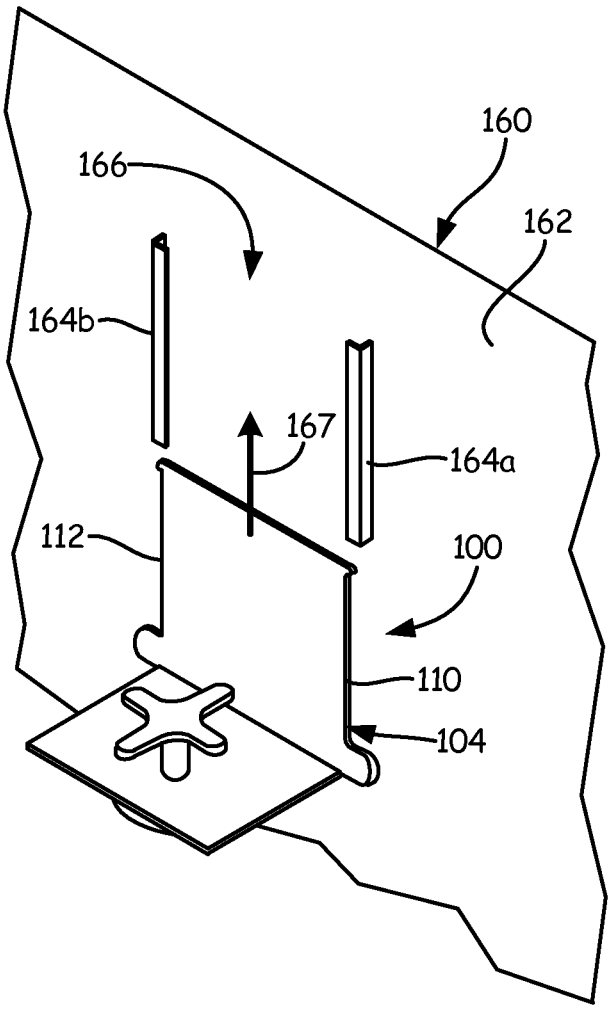
FIG. 9 is a perspective view of the adjustable bracket illustrated in FIG. 1 being mounted to a back side of a graphic panel.

FIG. 9 is a perspective view of adjustable bracket or graphic holder 100 being mounted to a back side 162 of a portion of a graphic or graphic panel 160. Mounted to back side 162 of graphic or graphic panel 160 are a pair of channel members 164*a* and 164*b*. Together channel members 164*a* and 164*b* form a channel 166 for receiving upper flange 104 of main body 102 of adjustable bracket or graphic holder 100. In particular, upper flange 104 is inserted into channel 166 by sliding upper flange 104 in a direction 167 such that channel member 164*a* engages side edge 110 of upper flange 104 and channel member 164*b* engages side edge 112 of upper flange 104.

Figure 10:
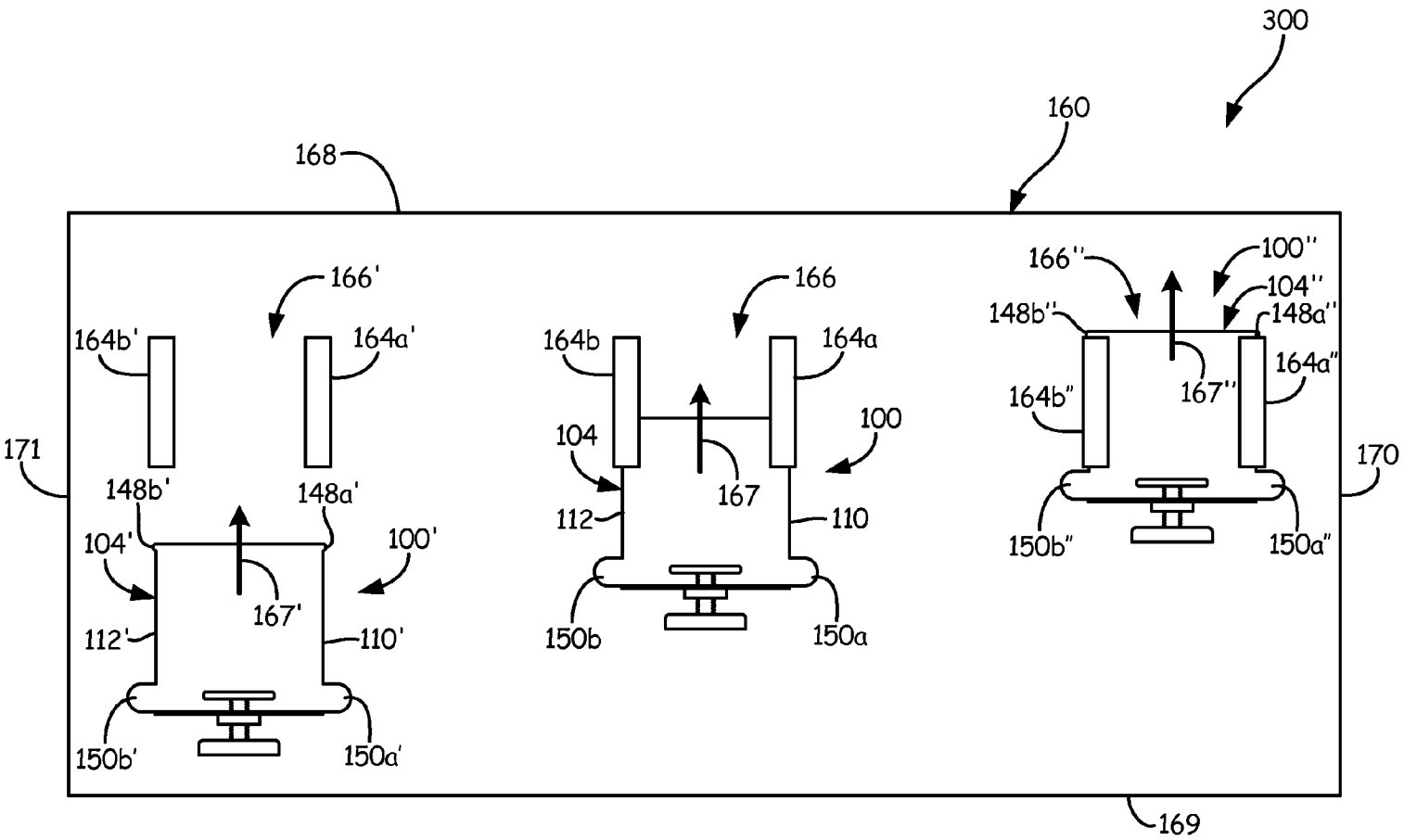
FIG. 10 is back view of a graphic panel illustrating multiple of the adjustable bracket illustrated in FIG. 1 being mounted to its back side.

FIG. 10 illustrates multiple of adjustable bracket or graphic holder 100 being coupled to back side 162 of graphic or graphic panel 160. As illustrated, graphic or graphic holder 160 includes a top edge 168, a bottom edge 169 and a pair of opposing side edges 170 and 171. A plurality of substantially identical adjustable brackets or graphic holders 100, 100' and 100" are each inserted into one of a plurality of spaced apart and substantially identical channels 166, 166' and 166". Channel 166 includes channel members 164*a* and 164*b*, channel 166' includes channel members 164*a'* and 164*b'* and channel 166" includes channel members 164*a"* and 164*b"*. As illustrated, each upper flange 104, 104' and 104" of each substantially identical adjustable bracket 100, 100' and 100" is inserted into a corresponding channel 166, 166' and 166" by sliding upper flange 104, 104' and 104" in a direction 167, 167' and 167" such that each channel member 164*a*, 164*a'* and 164*a"*engages a side edge, such as side edge 110 and side edge 110' (the corresponding side edge on upper flange 104" is hidden from view) and each channel member 164*b*, 164*b'* and 164*b"* engages an opposing side edge, such as side edge 112 and side edge 112' (the corresponding side edge on upper flange 104" is hidden from view). After each upper flange 104, 104' and 104" is inserted and received by each channel 166, 166' and 166", upper ears, such as upper ears 148*a'*, 148*b'*, 148*a"* and 148*b"* (the corresponding upper ears on upper flange 104 are hidden from view) as well as lower ears, such as lower ears 150*a*, 150*b*, 150*a'*, 150*b'*, 150*a"* and 150*b"*prevent each substantially identical adjustable bracket 100, 100' and 100" from sliding out of its corresponding channel 166, 166' and 166".

Figure 11:
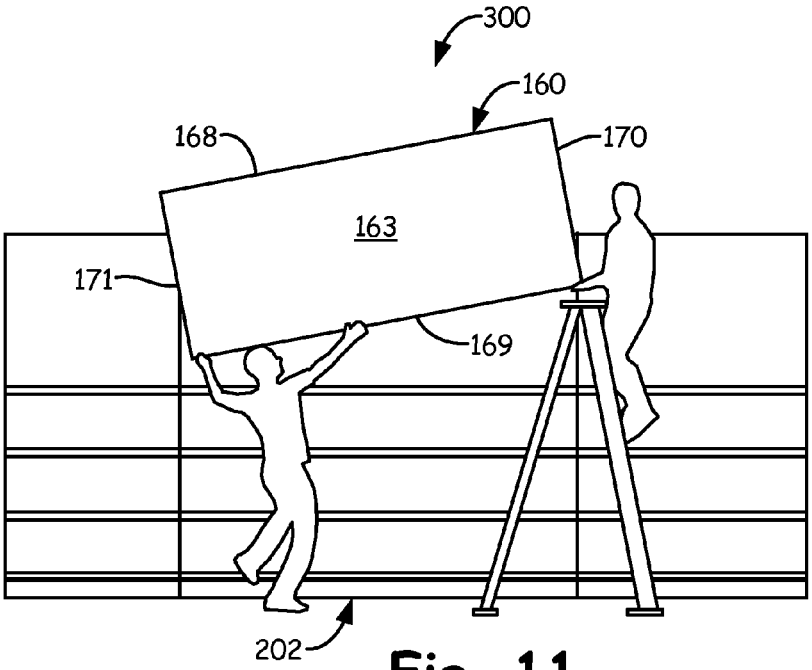
FIG. 11 illustrates the graphic panel illustrated in FIG. 10 being mounted to a top of a display unit according to one embodiment.

FIG. 11 illustrates a front view and therefore a front side 163 of graphic or graphic panel 160 being mounted to a display unit 202 according to one embodiment. As illustrated in FIGS. 11 and 10, graphic panel 160 extends across the entire width of display unit 202.

Figure 12:
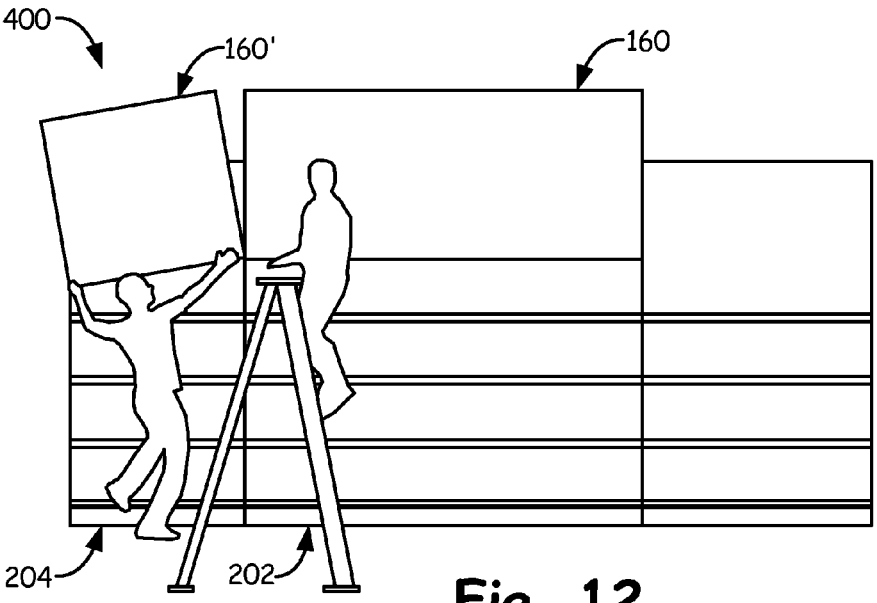
FIG. 12 illustrates another graphic panel being mounted to a display unit located adjacent the display unit that received the graphic panel illustrated in FIG. 11 according to one embodiment.
Figure 13:
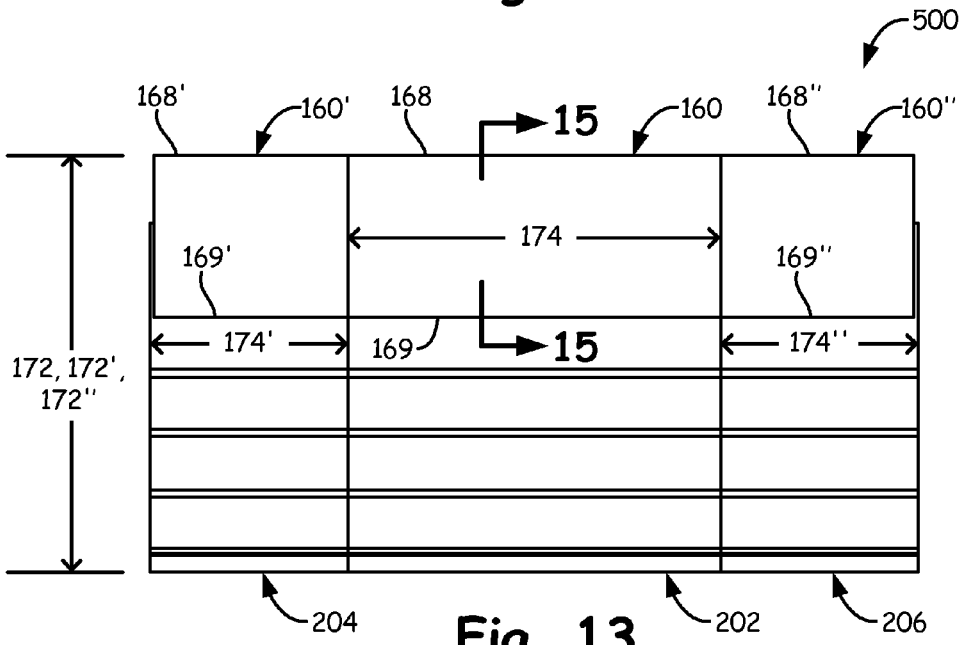
FIG. 13 is a front view of the graphic panel of FIG. 11, the graphic panel of FIG. 12 and yet another graphic panel all mounted to tops of multiple display units using multiple of the adjustable bracket illustrated in FIG. 1.

In one embodiment, together graphic panel 160 and the plurality of adjustable brackets 100, 100' and 100" provide a graphic panel assembly 300. FIG. 12 illustrates another graphic panel 160' being mounted to a display unit 204 using multiple of the adjustable bracket described above. Display unit 204 is located adjacent a side of display unit 202. Together graphic panels 160 and 160' and the multiple of the adjustable bracket 100 mounted to graphic panels 160 and 160' provide a graphic panel assembly 400. FIG. 13 is a front view of yet another graphic panel 160" mounted to a display unit 206 using multiple the adjustable bracket 100 described above. Display unit 206 is located adjacent an opposite side of display unit 202 from display unit 204. Together, graphic panels 160, 160' and 160" and the multiple of adjustable bracket 100 mounted to graphic panels 160, 160' and 160" provide graphic panel assembly 500.

When properly assembled and as illustrated in FIG. 13, graphic panels 160, 160' and 160" all should have substantially identical heights 172, 172' and 172" relative to a floor on which display units 202, 204 and 206 are supported. However, each of graphic panels 160, 160' and 160" can include different widths 174, 174' and 174". In particular, the widths 174, 174' and 174" of each graphic panel 160, 160' and 160" correspond with a width of the display unit to which the graphic panel is mounted. In addition, when properly assembled, top edges 168, 168' and 168" should all be in alignment with each other and bottom edges 169, 169' and 169" should all be in alignment with each other. Because display units 202, 204 and 206 are supported by what may be uneven floor and/or tops of the gondola display units 202, 204 and 206 may themselves be uneven, mounting graphic panels across multiple gondola display units can make the graphic panels appear crooked or out of alignment. To align top edges 168, 168' and 168" and bottom edges 169, 169' and 169", each of the plurality of adjustable brackets or graphic holders 100 that are mounted to and supporting graphic panels 160, 160' and 160" need to be adjusted so as to achieve graphic panel uniformity.

Figure 14:
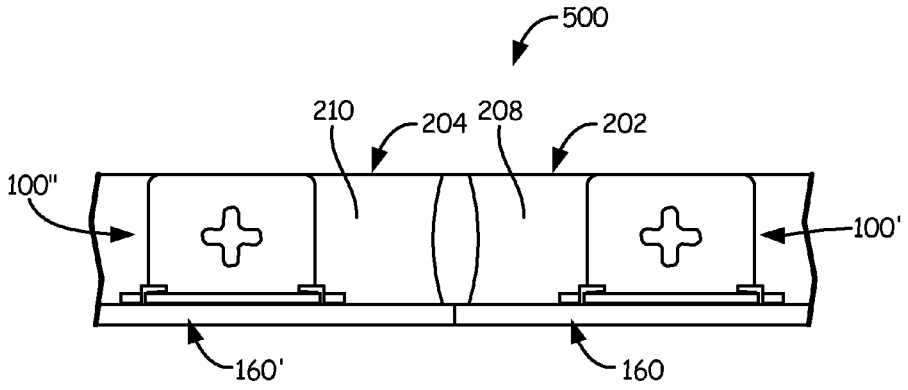
FIG. 14 illustrates a top view of a portion of two of the graphic panels and two of the display units of FIG. 13 including multiple of the adjustable bracket illustrated in FIG. 1 for retaining and positioning the graphic panels.

FIG. 14 illustrates a top view of a portion of graphic panel assembly 400 including a portion of graphic panels 160 and 160', a portion of display units 202 and 204 and a plurality of adjustable brackets or graphic holders 100' and 100' for retaining and positioning graphic panels 160 and 160' on top of gondola display units 202 and 204. Although adjustable bracket 100' was previously illustrated in FIG. 10 as being inserted into and received by channel 160' and is substantially identical to the adjustable bracket 100 described above, adjustable bracket 100'" was not previously illustrated. However, it should be understood that adjustable bracket 100'" is also substantially identical to adjustable bracket 100 described above.

Figure 15:
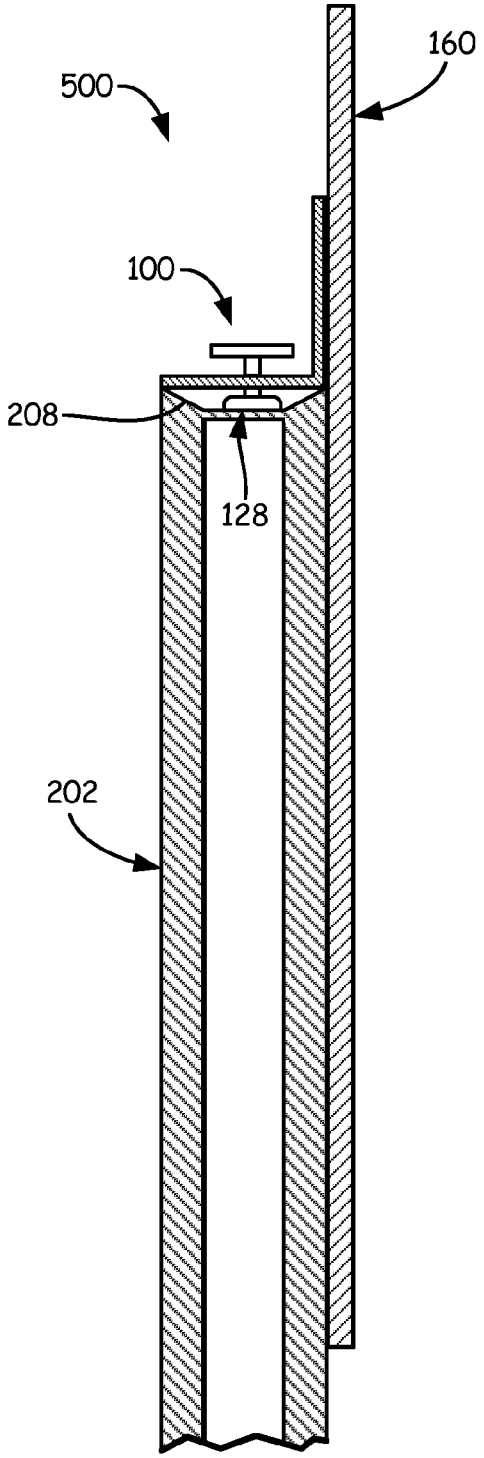
FIG. 15 is a section view taken through the line indicated in FIG. 13.

FIG. 15 is a section view taken through the line indicated in FIG. 13. As illustrated in FIG. 15, each magnetic foot 128 and therefore magnet 144 of each adjustable bracket is magnetically coupled to a top rail 208 of each display unit, including display unit 202. Therefore, the magnets in the plurality of adjustable brackets of graphic panel assembly 500 are magnetically coupled to tops of the plurality of adjacent gondola display units 202, 204 and 206.

To adjust the height 172, 172' and 172" of each graphic panel 160, 160' and 160" across its width 174, 174' and 174" to thereby align top edges 168, 168' and 168" as well as align bottom edges 169, 169' and 169", fasteners 108 of each adjustable bracket 100 are rotated to increase or decrease the relative distance 146 (FIG. 3) between bottom surface 107 of lower flange 106 and top surface 143 of magnetic housing 128. By rotating handle 134 of each fastener 108 in a clockwise direction 133 (FIG. 6), the adjustable bracket 100 effectively raises a portion of the top edge and a portion of the bottom edge of the graphic panel that is directly above and directly below where adjustable bracket 100 is mounted. By rotating handle 134 of each fastener 108 in a counterclockwise direction 135 (FIG. 6), the adjustable bracket 100 effectively lowers a portion of the top edge and a portion of the bottom edge of the graphic that is directly above and directly below where adjustable bracket 100 is mounted.

A method of adjusting height 172 of graphic panel 160 includes inserting upper flange 104 of a main body 102 of adjustable bracket 100 into a channel 166 that is coupled to a back side 162 of graphic panel 160. Adjustable bracket 100 is magnetically coupled to a top of a top rail 208 of display unit 202. Handle 334 of fastener 108 that is located in aperture or opening 124 of lower flange 106 is rotated in one of a clockwise direction 133 or a counterclockwise direction 135 to adjust height 174 of graphic panel 160. Height 174 is a height of top edge 168 of graphic panel 160 relative to a floor on which display unit 202 is supported.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A graphic holder comprising:

a base including an upper support portion for coupling to a graphic and a lower support portion having an aperture, wherein the upper support portion is oriented substantially normal to the lower support portion;

a hardware assembly comprising:

a bored rod having a threaded exterior and a threaded interior, wherein the threaded exterior is positioned within the aperture located in the lower support portion of the base; and a magnetic foot fixedly mated to the threaded interior of the bored rod; and wherein the bored rod is rotatable within the aperture to adjust a distance between the base and the magnetic foot.

2. The graphic holder of claim 1, wherein the base further comprises a nut fixedly secured to a bottom surface of the lower support portion and including a threaded hole that aligns with the aperture in the lower support portion of the base, wherein the threaded hole of the nut is rotatably mated with the threaded exterior of the bored rod.

3. The graphic holder of claim 1, wherein the magnetic foot comprises a permanent magnet positioned in a housing, wherein the housing and the permanent magnet comprise holes that align with each other and receive a threaded screw that fixedly mates the threaded interior of the bored rod with the magnetic foot.

4. The graphic holder of claim 3, wherein the bored rod further comprises a distal end that abuts a top surface of the housing of the magnetic foot when the threaded screw fixedly mates with the threaded interior of the bored rod.

5. The graphic holder of claim 1, wherein the hardware assembly further comprises a proximal handle fixedly attached to a proximal end of the bored rod and being located above the lower support portion of the base, wherein when the proximal handle is rotated clockwise the distance between the base and the magnetic foot increases to thereby adjust the graphic in an upward direction and wherein when the proximal handle is rotated counterclockwise the distance between the base and the magnetic foot decreases to thereby adjust the graphic in a downward direction.

6. The graphic holder of claim 1, wherein the upper support portion and the lower support portion comprise opposing side edges, wherein one of the side edges of the upper support portion is in alignment with one of the side edges of the lower support portion and wherein the other of the side edges of the upper support portion is in alignment with the other of the side edges of the lower support portion.

7. The graphic holder of claim 6, wherein the upper support portion further comprises a pair of upper ears each extending outwardly from each opposing side edge of the upper support portion and a pair of lower ears spaced apart from the pair of upper ears and each extending outwardly from each opposing side edge of the upper support portion, wherein each of the pair of lower ears extends a distance from each opposing side edge of the upper support portion that is greater than a distance each of the pair of upper ears extends from each opposing side edge of the upper support portion.

8. A graphic panel assembly comprising:

at least one adjustable bracket comprising:

a main body including an upper flange and a lower flange;

a fastener comprising:

a threaded stud located within an opening in the lower flange;

a handle fixedly attached to a first end of the threaded stud and located above the lower flange; and a magnet attached to a distal end of the threaded stud and located below the lower flange, the magnet being magnetically coupled to a display unit; and at least one channel mounted to a back side of at least one graphic panel and configured to receive the upper flange of the adjustable bracket; and wherein the fastener is rotatable within the opening in the lower flange to adjust a height of the graphic panel relative to a floor on which the display unit is supported.

9. The graphic panel assembly of claim 8, wherein the at least one adjustable bracket comprises a plurality of adjustable brackets and the at least one graphic panel comprises a plurality of graphic panels.

10. The graphic panel assembly of claim 9, wherein the magnets in the plurality of adjustable brackets are magnetically coupled to tops of a plurality of display units that are positioned adjacent to each other.

11. The graphic panel assembly of claim 10, wherein the fasteners of each adjustable bracket are rotated to adjust the height of each graphic panel relative to the floor to which the display units are supported so that top edges of the graphic panels are in alignment with each other and bottom edges of the graphic panels are in alignment with each other.

12. The graphic panel assembly of claim 11, wherein rotating the handle on the fastener of each adjustable bracket in a first direction raises a portion of the top edge of the graphic panel that is directly above where the adjustable bracket is received by the channel and wherein rotating the handle on the fastener of each adjustable bracket in a second direction lowers a portion of the top edge of the graphic panel directly above where the adjustable bracket is received by the channel.

13. The graphic panel assembly of claim 8, wherein the threaded stud comprises a bored stud having a threaded exterior and a threaded interior, wherein the threaded exterior is rotatable in the aperture in the lower flange and the magnet is fixedly mated with the threaded interior of the bored stud.

14. The graphic panel assembly of claim 8, wherein the upper flange and the lower flange of the main body comprise opposing side edges, wherein one of the side edges of the upper flange is in alignment with one of the side edges of the lower flange and wherein the other of the side edges of the upper flange is in alignment with the other of the side edges of the lower flange.

15. The graphic panel assembly of claim 8, wherein the upper flange further comprises a pair of upper ears each extending outwardly from each opposing side edge of the upper flange and a pair of lower ears spaced apart from the pair of upper ears and each extending outwardly from each opposing side edge of the upper flange, wherein each of the pair upper ears and each of the pair of lower ears prevent the at least one adjustable bracket from sliding out of the at least one channel.

16. A graphic panel assembly comprising:

a graphic panel having at least one channel mounted to a back side of the graphic panel; and at least one adjustable bracket including a main body having an upper flange and a lower flange coupled to the upper the flange and a fastener, wherein the upper flange is insertably located in the at least one channel and wherein the fastener includes a threaded stud located within an opening in the lower flange, a handle fixed to a first end of the threaded stud and located above the lower flange and a magnet fixed to the threaded stud and located below the lower flange;

wherein the at least one adjustable bracket is magnetically coupled to a top of a display unit so as to hold the graphic panel above the display unit; and wherein the handle of the fastener is rotated in one of a clockwise direction or a counterclockwise direction to adjust a height of the graphic panel relative to a floor on which the display unit is supported.

17. The graphic panel assembly of claim 16, wherein when the handle of the fastener is rotated in the clockwise direction a portion of a top edge of the graphic panel that is directly above where the adjustable bracket is inserted into the channel is raised and wherein when the handle of the fastener is rotated in the counterclockwise direction the portion of the top edge of the graphic panel that is directly above where the adjustable bracket is inserted into the channel is lowered.

18. The graphic panel assembly of claim 16, wherein the upper flange comprises a pair of upper ears that extend outwardly from opposing side edges of the upper flange and a pair of lower ears spaced apart from the pair of uppers ears that extend outwardly from the opposing side edges of the upper flange, wherein the pair of upper ears and the pair of lower ears secure the upper flange to the channel.

19. The method of claim 18, wherein the pair of lower ears extend outwardly from the opposing side edges of the upper flange a distance greater than a distance the pair of upper ears extend outwardly from the opposing side edges of the upper flange.

20. A graphic holder comprising:

a base including an upper support portion for coupling to a graphic and a lower support portion having an aperture, wherein the base further comprises a nut fixedly secured to a bottom surface of the lower support portion and including a threaded hole that aligns with the aperture in the lower support portion of the base;

a hardware assembly comprising:

a bored rod having a threaded exterior and a threaded interior, wherein the threaded exterior is positioned within the aperture located in the lower support portion of the base; and a magnetic foot fixedly mated to the threaded interior of the bored rod; and wherein the bored rod is rotatable within the aperture to adjust a distance between the base and the magnetic foot and wherein the threaded hole of the nut is rotatably mated with the threaded exterior of the bored rod.

* * * * *